US005159297A

United States Patent [19]

Tateno

[11] Patent Number: 5,159,297

[45] Date of Patent: Oct. 27, 1992

[54] SWITCHING CIRCUIT HAVING CONSTANT IMPEDANCE REGARDLESS SWITCHING OPERATION THEREOF

[75] Inventor: Yasunori Tateno, Kawasaki, Japan

[73] Assignee: Fujitsu Limited, Kawasaki, Japan

[21] Appl. No.: 707,826

[22] Filed: May 30, 1991

[30] Foreign Application Priority Data

May 31, 1990 [JP] Japan ..... 2-142367

[51] Int. Cl.[5] ..... H01P 1/15

[52] U.S. Cl. ..... 333/104; 307/571; 333/262

[58] Field of Search ..... 333/103, 104, 262; 307/243, 244, 571

[56] References Cited

U.S. PATENT DOCUMENTS 4,939,485 7/1990 Eisenberg ..... 333/104

5,061,911 10/1991 Weidman et al. ..... 333/104

FOREIGN PATENT DOCUMENTS 1-264014 10/1989 Japan .

*Primary Examiner*—Paul Gensler

*Attorney, Agent, or Firm*—Staas & Halsey

[57] ABSTRACT

A switching circuit comprises a transmission line having a specific impedance value and connected to an input terminal, a first switching portion including a plurality of first transistors connected in parallel between the transmission line and the ground, and a second switching portion including a second transistor and a resistor connected in parallel between the transmission line and an output terminal. The first transistors of the first switching portion and the second transistor of the second switching portion are complementally switched. Consequently, the switching circuit can be enabled to impedance-match with an objective circuit (for example, a measurement apparatus, a transceiver, a phased array system, and the like), and loss of signal transfer can be decreased regardless of the switching ON or OFF states of the switching circuit.

16 Claims, 10 Drawing Sheets

101'
102'
103'
IN
OUT
D
S
G
GND
$Z_{01}$
$Z_{02}$
$CS_{03}$
$Q_{010}$
$Q_{020}$
$Q_{03}$
$R_{03}$
FIRST SWITCHING PORTION
SECOND SWITCHING PORTION

SWITCHING CIRCUIT HAVING CONSTANT IMPEDANCE REGARDLESS SWITCHING OPERATION THEREOF

BACKGROUND OF THE INVENTION

1. Field of the Invention

The present invention relates to a switching circuit, more particularly, to a switching circuit used for a measurement apparatus, a phase shifter, or a phased array system. Furthermore, the present invention also relates to a single pole double throw switch having two switching circuits used for a transceiver, and the like.

2. Description of the Related Art

Recently, a switching circuit is used in various apparatuses or systems, and a loss of signal transfer must be decreased regardless of the insertion of a switching circuit thereto. Note, when applying the switching circuit to an objective circuit, an impedance of the switching circuit must be matched with that of the objective circuit in order to decrease the loss of signal transfer. Namely, a characteristic impedance of the switching circuit must be matched with internal impedances of circuits connected to an input terminal and an output terminal of the switching circuit regardless of the ON or OFF state of the switching circuit.

For example, the prior art switching circuit comprises a first switching portion and a second switching portion. The first switching portion includes two FETs (Field Effect Transistors) connected in series between an input terminal and the second switching portion, and the second switching portion includes an FET and a resistor connected in series between a transmission line and the ground GND. Note, a first control signal is supplied to gate electrodes of the two FETs of the first switching portion, a second control signal is supplied to a gate electrode of the FET of the second switching portion, and the first control signal and the second control signal are complementary signals.

In this prior art switching circuit, a switching operation is carried out by the FETs of the first switching portion, and an impedance matching operation is carried out by the FET of the second switching portion. However, in the first switching portion of the switching circuit, two FETs are connected in series, and thus a loss of signal transfer becomes large by resistance components (resistive components) of the FETs.

Note, in the prior art, another switching circuit has been provided. For example, Japanese Unexamined Patent Publication (Kokai) NO. 1-264014 discloses a diode switching circuit.

SUMMARY OF THE INVENTION

It is an object of the present invention to provide a switching circuit for enabling to impedance-match with an objective circuit (for example, a measurement apparatus, a transceiver, a phased array system, and the like) regardless of the ON or OFF state of the switching circuit. It is another object of the present invention to provide a switching circuit having a small loss of signal transfer. It is still another object of the present invention to provide a single pole double throw switch having a small loss of signal transfer.

According to the present invention, there is provided a switching circuit, for controlling the transmission of signals by switching operation thereof, comprising: an input terminal, for receiving the signals; an output terminal, for outputting or not outputting the signals; a transmission line having a specific impedance value, connected to the input terminal, for transferring the signals; a first switching portion including a plurality of first transistors connected in parallel between the transmission line and the ground, for controlling the impedance between the transmission line and the ground in accordance with a first control signal supplied to a control electrode Of each of the first transistors; and a second switching portion including a second transistor and a resistor connected in parallel between the transmission line and the output terminal, for controlling the impedance between the transmission line and the output terminal in accordance with a second control signal supplied to a control electrode of the second transistor, wherein the first transistors and the second transistor are complementarily switched by the first and second control signals.

The first transistors and the second transistor may be the same conduction type field effect transistors, and the first and second control signals may be complementary signals. The signals inputting into the switching circuit may be microwave signals. The first switching portion may include a plurality of transistors and a plurality of impedance components of the transmission line, a length of the transmission line corresponding to a first impedance component connected to an input terminal may be the same length of the transmission line corresponding to a last impedance component connected to the second switching portion, and lengths of the transmission line corresponding to intermediate impedance components placed between the first and last impedance components may be specified to the same.

The length of the transmission line corresponding to each of the first and last impedance components may be shorter than the length of the transmission line corresponding to each of the intermediate impedance components placed between the first and last impedance components. The length of the transmission line corresponding to each of the first and last impedance components may be specified as a half length of the transmission line corresponding to each of the intermediate impedance components placed between the first and last impedance components. A gate width of each of the first transistors may be shorter than a gate width of the second transistor, further, gate width of each of the first transistors may be specified as a half length of the second transistor. The transmission line may be a microstrip line.

According to the present invention, there is also provided a single pole double throw switch, including two switching circuits, for selecting one of the two switching circuits for transferring signals through the selected one switching circuit, wherein each of the two switching circuits comprises: an input terminal, for receiving the signals; an output terminal, for outputting or not outputting the signals; a transmission line having a specific impedance value, connected to the input terminal, for transferring the signals; a first switching portion including a plurality of first transistors connected in parallel between the transmission line and the ground, for controlling the impedance between the transmission line and the ground in accordance with a first control signal supplied to a control electrode of each of the first transistors; and a second switching portion including a second transistor and a resistor connected in parallel between the transmission line and the output terminal, for controlling the impedance between the transmission line and the output terminal in accordance with a second control signal supplied to a control electrode of the second transistor, wherein the first transistors and the second transistor are complementarily switched by the first and second control signals.

The input terminal of each of the two switching circuits may be the same, and a third transistor may be inserted in series between the input terminal and the transmission line in each of the two switching circuit. The first transistors, the second transistor, and the third transistor may be the same conduction type field effect transistors, and the first and second control signals may be complementary signals. The signals inputting into the single pole double throw switch may be microwave signals. A gate width of each of the first transistors may be shorter than a gate width of the second transistor, and further, the gate width of each of the first transistors may be specified as a half length of the second transistor. The transmission line may be a microstrip line.

BRIEF DESCRIPTION OF THE DRAWINGS

The present invention will be more clearly understood from the description of the preferred embodiments as set forth below with reference to the accompanying drawings, wherein.

DESCRIPTION OF THE PREFERRED EMBODIMENTS

First, switching circuits according to the prior art and the related art will be explained with reference to FIGS. 1, 2, and 3A to 3C.

Figure 1:
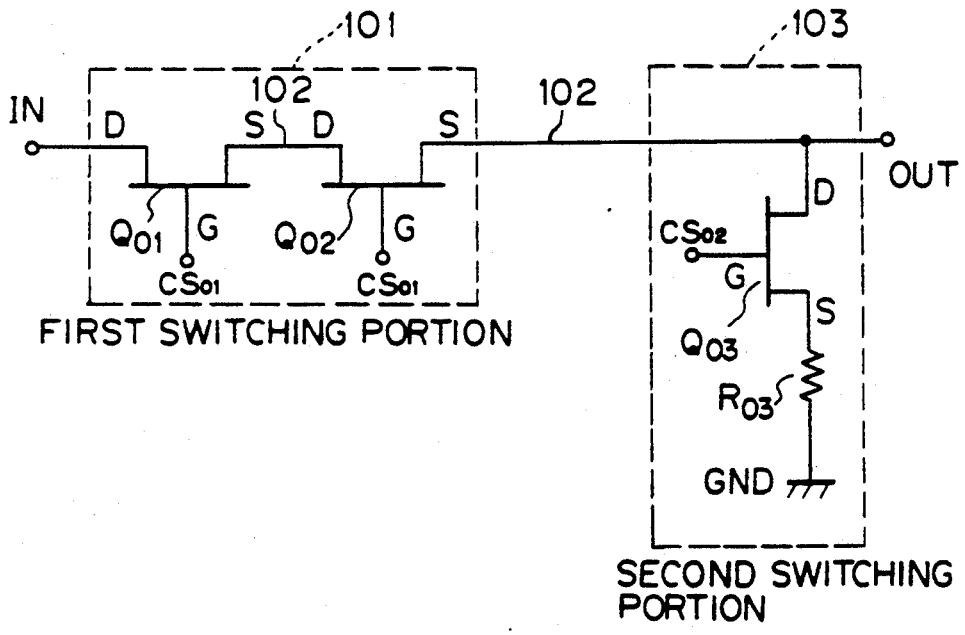
Fig. 1 (PRIOR ART)
FIG. 1 is a circuit diagram indicating an example of a switching circuit according to the prior art.

FIG. 1 is a circuit diagram indicating an example of a switching circuit according to the prior art. In FIG. 1, reference numeral 101 denotes a first switching portion, 102 denotes a transmission line, and 103 denotes a second switching portion. Further, reference IN denotes an input terminal of the switching circuit, OUT denotes an output terminal of the switching circuit, $Q_{01}$, $Q_{02}$, and $Q_{03}$ denote FETs (Field Effect Transistors), and $R_{03}$ denotes a resistor.

As shown in FIG. 1, the first switching portion 101 includes two FETs $Q_{01}$ and $Q_{02}$ connected in series between the input terminal IN and the second switching portion 103, and the second switching portion 103 includes the FET $Q_{03}$ and the resistor $R_{03}$ connected in series between the transmission line 102 (or the output terminal OUT) and the ground GND. Note, as shown in FIG. 1, the transmission line 102, which may be a microstrip line, is provided between a source electrode of the FET $Q_{01}$ and a drain electrode of the FET $Q_{02}$ and provided between a source electrode of the FET $Q_{02}$ and the output terminal OUT. Further, a first control signal $CS_{01}$ is supplied to gate electrodes of the FETs $Q_{01}$ and $Q_{02}$, a second control signal $CS_{02}$ is supplied to a gate electrode of the FET $Q_{03}$, and the first control signal $CS_{01}$ and the second control signal $CS_{02}$ are complementary signals.

In this prior art switching circuit, a switching operation is carried out by the FETs $Q_{01}$ and $Q_{02}$ of the first switching portion 101, and an impedance matching operation is carried out by the FET $Q_{03}$ of the second switching portion. Concretely, in the case that the FETs $Q_{01}$, $Q_{02}$ and $Q_{03}$ are N-channel type transistors, and when the first control signal $CS_{01}$ is specified to a high level and the second control signal $CS_{02}$ is specified to a low level, the FETs $Q_{01}$ and $Q_{02}$ are switched ON and the FET $Q_{03}$ is switched OFF, so that the input terminal IN is connected to the output terminal OUT through the FETs $Q_{01}$ and $Q_{02}$ and the transmission line 102 (which is a switching ON state of the switching circuit). Conversely, when the first control signal $CS_{01}$ is specified to a low level and the second control signal $CS_{02}$ is specified to a high level, the FETs $Q_{01}$ and $Q_{02}$ are switched OFF and the FET $Q_{03}$ is switched ON, so that the input terminal IN is disconnected from the output terminal OUT (which is a switching OFF state of the switching circuit).

Note, in the prior art switching circuit, a plurality of FETs (for example, two FETs $Q_{01}$ and $Q_{02}$) provided in the first switching portion 101 are used to decrease a leak current flowing through the drain electrode and the source electrode of each of the FETs when the FETs are switched OFF.

Generally, internal impedances of a measurement apparatus, a transceiver, a phased array system, and the like are specified to 50 Ω, and thus a switching circuit must be constituted such that a characteristic impedance of the switching circuit is specified to 50 Ω regardless of the ON or OFF state thereof.

First, when the switching circuit is at a switching ON state, the FETs $Q_{01}$ and $Q_{02}$ are switched ON, and the FET $Q_{03}$ is switched OFF, so that the second switching portion 103 is disconnected, or the resistor $R_{03}$ is not connected between the transmission line 102 and the ground GND. Therefore, an impedance of the switching circuit is determined by the first switching portion 101, and the impedance of the switching circuit is specified to 50 Ω.

Next, when the switching circuit is at a switching OFF state, the FETs $Q_{01}$ and $Q_{02}$ are switched OFF, and the FET $Q_{03}$ is switched ON, so that the first switching portion 101 is disconnected and the second switching portion 103 is connected. Namely, the resistor $R_{03}$ is connected between the transmission line 102 and the ground GND through the FET $Q_{03}$, and an impedance of the switching circuit is determined by the second switching portion 101, or the resistor $R_{03}$, so that the impedance of the switching circuit is specified to 50 Ω.

Consequently, the prior art switching circuit shown in FIG. 1 can be matched with the circuits (objective circuits) connected to the input terminal IN and the output terminal OUT, and a reflection of signal transfer can be prevented.

However, in the first switching portion 101 of the switching circuit shown in FIG. 1, a plurality of FETs (two FETs $Q_{01}$ and $Q_{02}$) are connected in series between the input terminal IN and the second switching portion 103 (or the output terminal OUT), and thus a loss of signal transfer becomes large by the resistance components of the FETs. This problem becomes greater in accordance with the number of the FETs provided in the first switching portion 101 for decreasing the leak current.

Figure 2:
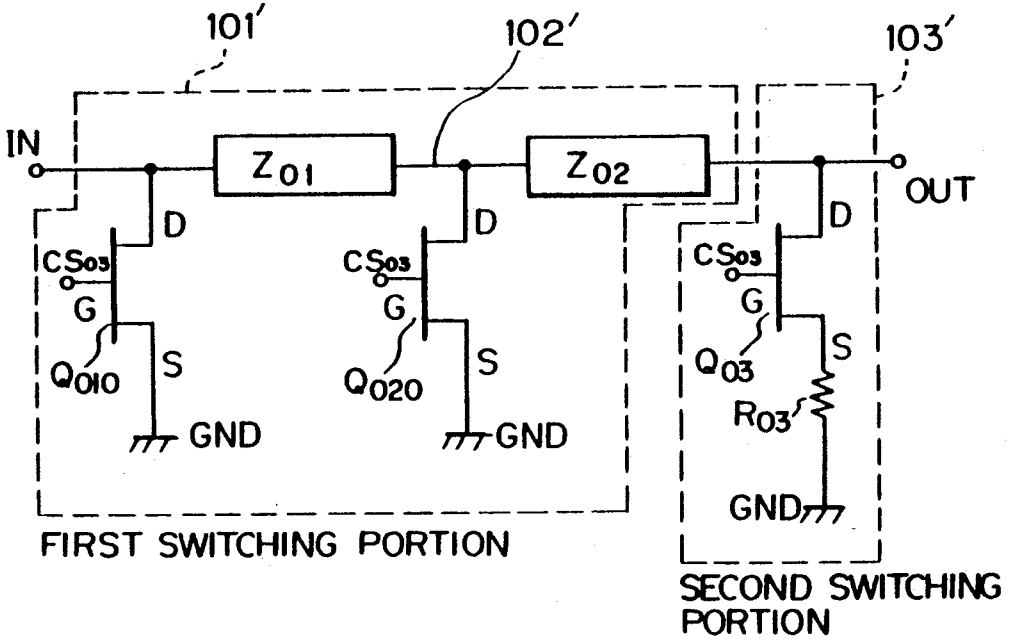
FIG. 2 is a circuit diagram indicating an example of a switching circuit according to the related art.

FIG. 2 is a circuit diagram indicating an example of a switching circuit according to the related art. In FIG. 2, reference numeral 101 ' denotes a first switching portion, 102 ' denotes a transmission line, and 103 ' denotes a second switching portion. Further, reference IN denotes an input terminal of the switching circuit, OUT denotes an output terminal of the switching circuit, $Q_{010}$, $Q_{020}$, and $Q_{03}$ denote FETs, and $R_{03}$ denotes a resistor.

As shown in FIG. 2, the first switching portion 101 ' includes two FETs $Q_{010}$ and $Q_{020}$ connected in parallel between the transmission line 102 ' and the ground GND, and the second switching portion 103 ' includes the FET $Q_{03}$ and the resistor $R_{03}$ connected in series between the transmission line 102 ' and the ground GMD. Mote, as shown in FIG. 2, references $Z_{01}$ and $Z_{02}$ denote impedance components of the transmission line 102', and the transmission line 102 ' (which may be a microstrip line) is provided between the input terminal IN and the output terminal OUT. Further, a control signal $CS_{03}$ is supplied to gate electrodes of all of the FETs $Q_{010}$, $Q_{020}$, and $Q_{03}$.

In this related art switching circuit shown in FIG. 2, when the switching circuit is at a switching ON state, all of the FETs $Q_{010}$, $Q_{020}$, and $Q_{03}$ are switched OFF, or the FETs $Q_{010}$, $Q_{020}$, and $Q_{03}$ are disconnected, so that the input terminal IN and the output terminal OUT is directly connected by the transmission line 102', and the transmission line 102 ' is not connected to the ground through any FETs. Conversely, when the switching circuit is at a switching OFF state, all of the FETs $Q_{010}$, $Q_{020}$, and $Q_{03}$ are switched ON, and input signals supplied to the input terminal IN are reflected by the ON state FETs $Q_{010}$ and $Q_{020}$. Note, impedances of the FETs $Q_{010}$ and $Q_{020}$ are sufficiently smaller than the impedance components $Z_{01}$ and $Z_{02}$ of the transmission line 102', so that the input signals are not transferred from the input terminal IN to the output terminal OUT. Further, an impedance of the output terminal OUT of the switching circuit is determined by the second switching portion. Namely, the impedance of the output terminal OUT of the switching circuit is determined by the resistor $R_{03}$ connected between the transmission line 102 ' and the ground GND through the FET $Q_{03}$.

Note, in the related art switching circuit shown in FIG. 2, when the switching circuit is at a switching ON state, no FET is inserted in the transmission line 102', or no FET is inserted in series between the input terminal IN and the output terminal OUT, and thus a loss of signal transfer caused by the transmission line 102 ' becomes exceedingly small. Further, in the switching ON state, a characteristic impedance of the switching circuit can be determined by the impedance components $Z_{01}$ and $Z_{02}$ of the transmission line 102 ' and capacitance components (capacitive components) of the FETs $Q_{010}$, $Q_{020}$, and $Q_{03}$. Nevertheless, in the switching OFF state, the first switching portion 101 ' is connected, or the FETs $Q_{010}$ and $Q_{020}$ are connected in parallel between the transmission line 102 ' and the ground GND. Namely, when FETs $Q_{010}$ and $Q_{020}$ are switched ON, a composite impedance (internal impedance) of the first switching portion 101 ' is exceedingly low, and a composite impedance (characteristic impedance of the switching circuit) of the second switching portion 103 ' cannot be specified to 50 Ω, so that an impedance matching between the switching circuit and an objective circuit (a measurement apparatus, a transceiver, a phased array system, and the like) cannot be realized.

Figures 3A, 3B, 3C:
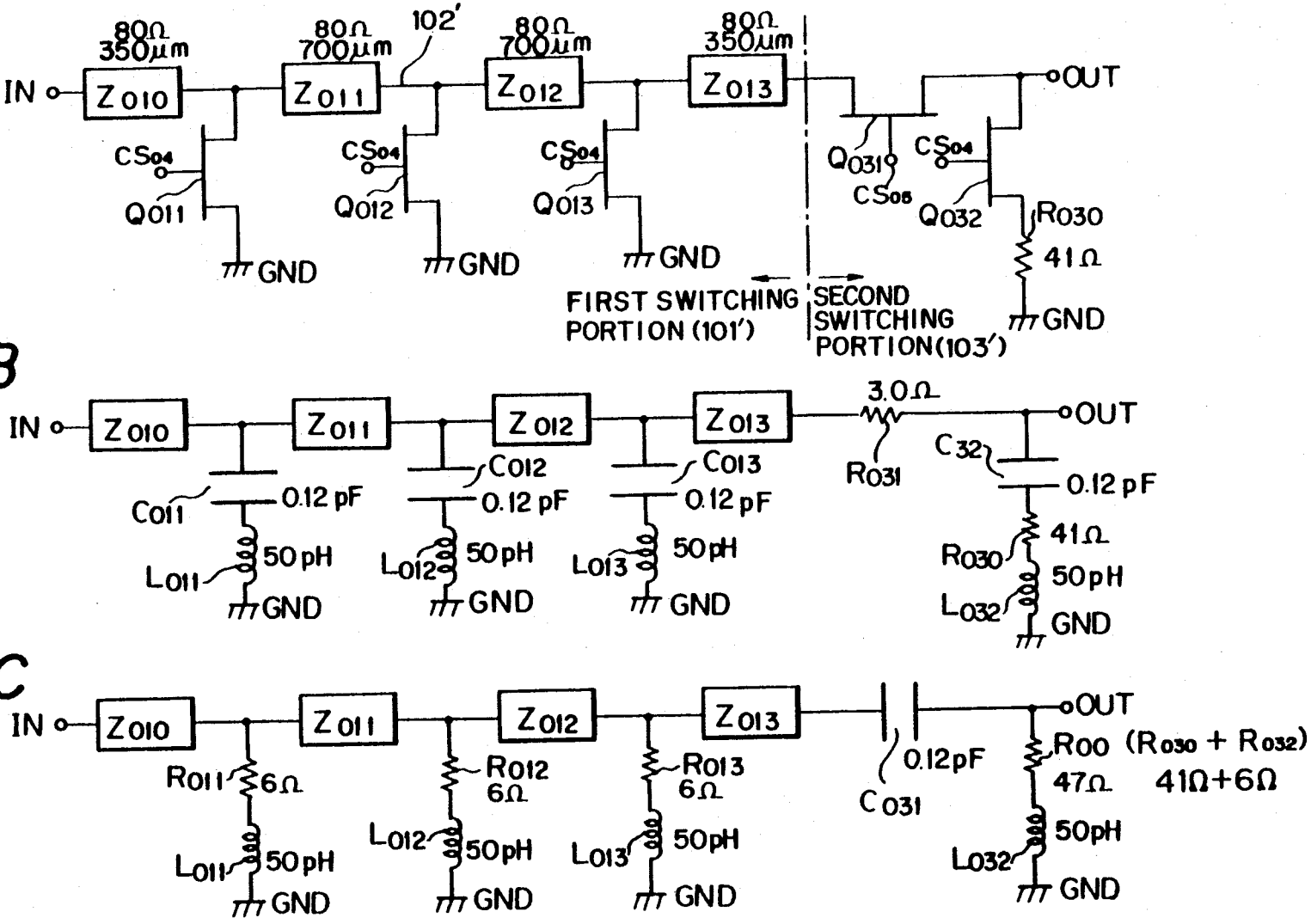
FIG. 3A is a circuit diagram indicating a modified example of the switching circuit shown in FIG. 2.
FIGS. 3B and 3C are equivalent circuit diagrams indicating switching ON and OFF states of the switching circuit shown in FIG. 3A.

FIG. 3A is a circuit diagram indicating a modified example of the switching circuit shown in FIG. 2, and FIGS. 3B and 3C are equivalent circuit diagrams indicating switching ON and OFF states of the switching circuit shown in FIG. 3A.

By comparing the switching circuit shown in FIG. 3A with that shown in FIG. 2, in the first switching portion 101 ' of the modified example shown in FIG. 3A, two impedance components (which are connected in series between the input terminal IN and the second switching portion 103') and one FET (which is connected between the transmission line 102 ' and the ground GND) are added to the configuration of the first switching portion shown in FIG. 2, and in the second switching portion 103 ' of the modified example, one FET (which is connected in series between the first switching portion 101 ' and the output terminal OUT) is added to the configuration of the second switching portion shown in FIG. 2.

As shown in FIG. 3A, the first switching portion 101 ' includes three FETs $Q_{011}$, $Q_{012}$, and $Q_{013}$ connected in parallel between the transmission line 102 ' and the ground GND, and the second switching portion 103 ' includes two FETs $Q_{031}$ and $Q_{032}$ and a resistor $R_{030}$. Note, in the second switching portion 103', one FET $Q_{031}$ is connected between the first switching portion 101 ' and the output terminal OUT, and the other FET $Q_{032}$ and the resistor $R_{030}$ are connected in series between the transmission line 102 ' (or the output terminal OUT) and the ground GND. Further, as shown in FIG. 3A, references $Z_{010}$, $Z_{011}$, $Z_{012}$, and $Z_{013}$ denote impedance components of the transmission line 102', and the transmission line 102 ' is provided between the input terminal IN and the output terminal OUT. In addition, a first control signal $CS_{04}$ is supplied to gate electrodes of the FETs $Q_{011}$, $Q_{012}$, $Q_{013}$, and $Q_{032}$, a second control signal $CS_{05}$ is supplied to a gate electrode of the FET $Q_{031}$ and the first control signal $CS_{04}$ and the second control signal $CS_{05}$ are complementary signals.

In this related art switching circuit, as shown in FIG. 3A, a resistance value of each of the impedance components $Z_{010}$,$Z_{011}$,$Z_{012}$, $Z_{013}$ is, for example, specified to 80 Ω, a length of each of the transmission lines corresponding to the impedance components $Z_{010}$ and $Z_{013}$ is, for example, specified to 350 μm, and a length of each of the transmission lines corresponding to the impedance components $Z_{011}$ and $Z_{012}$ is, for example, specified to 700 μm. Note, a resistance value of the resistor $R_{030}$ is, for example, specified to 41 Ω. Further, each length of the transmission lines are determined above (350 μm or 700 μm), when the transmission lines (microstrip lines) are formed on a GaAs (Gallium Arsenic) substrate whose dielectric constant $\epsilon=13$.

As shown in FIG. 3B, in this related art switching circuit, when the switching circuit is at a switching ON state, the FETs $Q_{011}$, $Q_{012}$, $Q_{013}$, and $Q_{032}$ are switched OFF, and the FET $Q_{031}$ is switched ON. Note, each of the OFF state FETs $Q_{011}$, $Q_{012}$, $Q_{013}$, $Q_{032}$ is regarded as a capacitor ($C_{011}$, $C_{012}$, $C_{013}$, $C_{032}$), and the ON state FET $Q_{031}$ is regarded as a resistor ($R_{031}$). Note, a capacitance component $C_{011}$, $C_{012}$, $C_{013}$, $C_{032}$ of each of the OFF state FETs $Q_{011}$, $Q_{012}$, $Q_{013}$, $Q_{032}$ is, for example, specified to 0.12 of, and an inductive component $L_{011}$, $L_{012}$, L013 between the transmission line 102' and the ground GND through each of the FETs $Q_{011}$, $Q_{012}$,$Q_{013}$ $_p$is, for example, specified to 50 pH. Similarly, an inductive component $L_{032}$ between the transmission line 102 ' (or output terminal OUT) and the ground GND through the FET $Q_{032}$ and the resistor $R_{030}$ is, for example, specified to 50 pH. Further, a resistance component $R_{031}$ of the ON state FET $Q_{031}$ is, for example, specified to 3.0 Ω.

Figure 6:
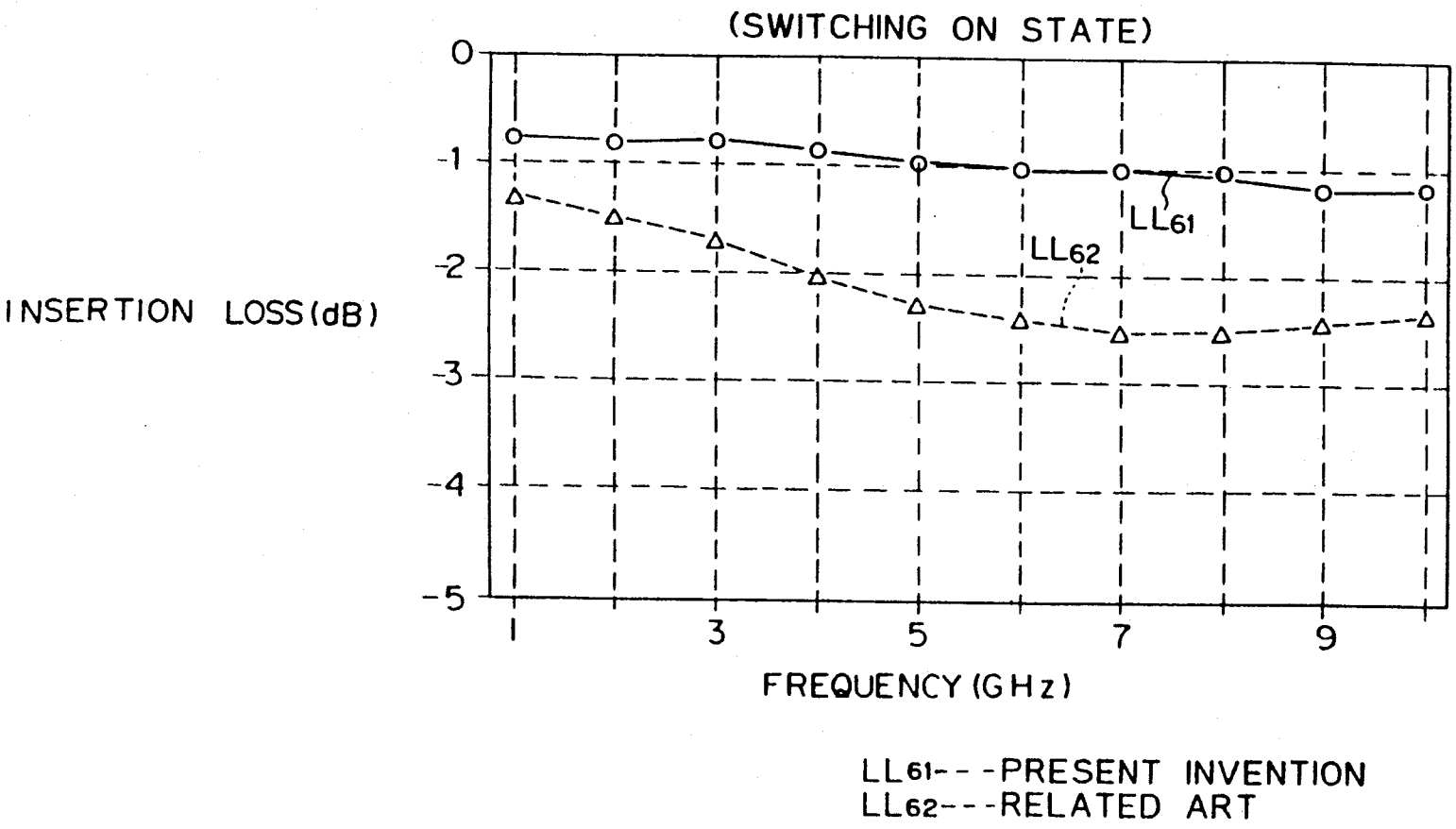
FIG. 6 is a diagram indicating relationships between an insertion loss and a frequency in the switching circuits according to the related art and the present invention.

Note, the relationship between an insertion loss and a frequency in this related art switching circuit is indicated by a broken line $LL_{62}$ in FIG. 6.

As shown in FIG. 3C, in this related art switching circuit, when the switching circuit is at a switching OFF state, the FETs $Q_{011}$, $Q_{012}$, $Q_{013}$, and $Q_{032}$ are switched ON, and the FET $Q_{031}$ is switched OFF. Note, each of the ON state FETs $Q_{011}$, $Q_{012}$, $Q_{013}$, $Q_{032}$ is regarded as a resistor ($R_{011}$,$R_{012}$,$R_{013}$,$R_{032}$), and the OFF state FET $Q_{031}$ is regarded as a capacitor ($C_{031}$) Further, a resistance component $R_{011}$,$R_{012}$,$R_{013}$,$R_{032}$ of each of the ON state FETs $Q_{011}$, $Q_{012}$, $Q_{013}$, $Q_{032}$ is, for example, specified to 6 Ω, and a capacitance component $C_{031}$ of the OFF state FET $Q_{031}$ is, for example, specified to 0.12 of. In FIG. 3C, a resistance $R_{00}$ (47 Ω) is a combined resistance of the resistors $R_{030}$ (41 Ω) and $R_{032}$ (6 Ω).

Figure 7:
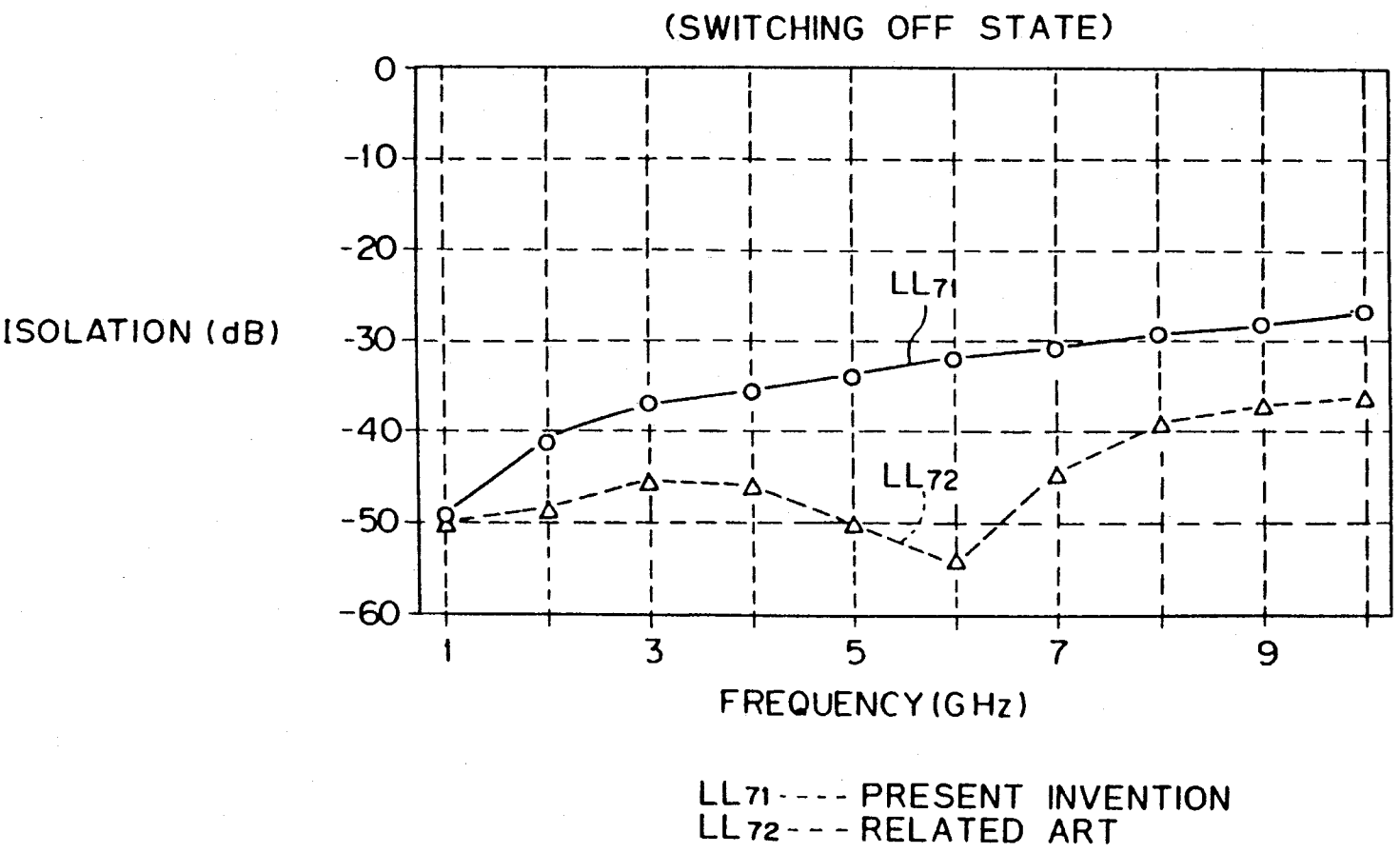
FIG. 7 is a diagram indicating relationships between an isolation and a frequency in the switching circuits according to the related art and the present invention.
Figure 8:
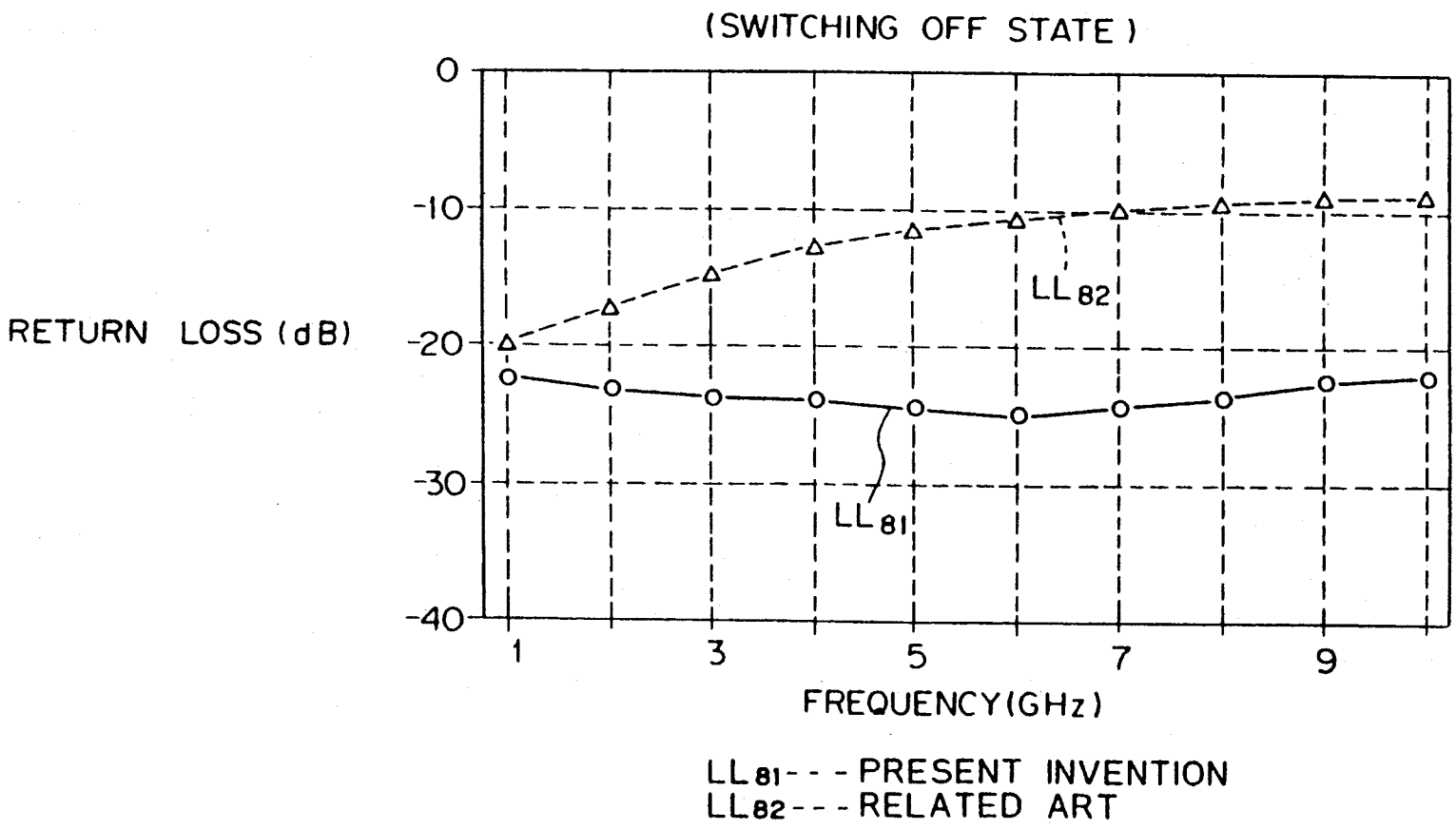
FIG. 8 is a diagram indicating relationships between a return loss and a frequency in the switching circuits according to the related art and the present invention.

Note, the relationship between an isolation and a frequency in this related art switching circuit is indicated by a broken line $LL_{72}$ in FIG. 7, and the relationship between a return loss and a frequency in this related art switching circuit is indicated by a broken line $LL_{82}$ in FIG. 8.

Next, the preferred embodiments of a switching circuit and a single pole double throw switch according to the present invention will be explained below.

Figure 4:
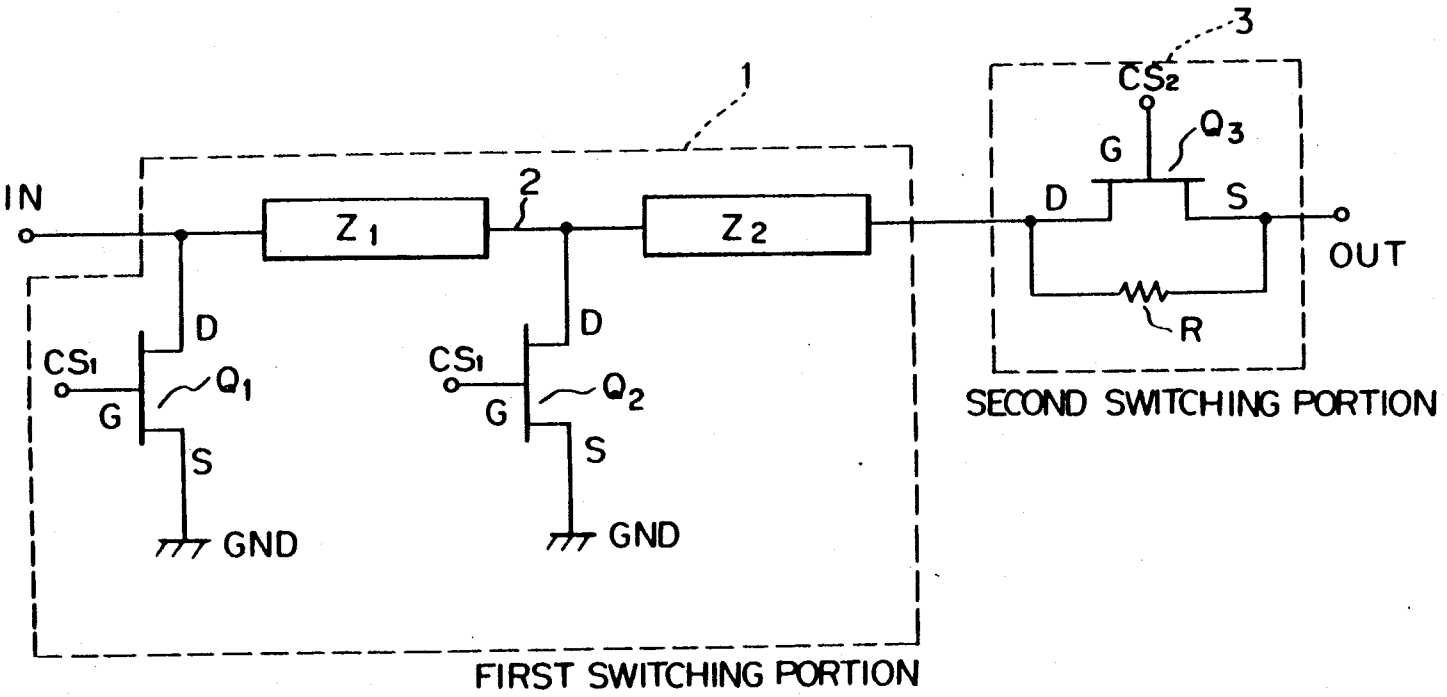
FIG. 4 is a circuit diagram indicating an embodiment of a switching circuit according to the present invention.

FIG. 4 is a circuit diagram indicating an embodiment of a switching circuit according to the present invention. In FIG. 4, reference numeral 1 denotes a first switching portion, 2 denotes a transmission line, and 3 denotes a second switching portion. Further, reference IN denotes an input terminal of the switching circuit, OUT denotes an output terminal of the switching circuit, $Q_1$, $Q_2$, and $Q_3$ denote FETs (Field Effect Transistors), and R denotes a resistor. Note, each of the FETs $Q_1$, $Q_2$, and $Q_3$ are, for example, formed by a junction type FET, a MOS (Metal Oxide Silicon) type FET, and the like.

As shown in FIG. 4, the first switching portion 1 includes two FETs $Q_1$ and $Q_2$ connected in parallel between the transmission line 2 and the ground GND, and the second switching portion 3 includes the FET $Q_3$ and the resistor R connected in parallel between the first switching portion 1 and the output terminal OUT. Note, as shown in FIG. 4, references $Z_1$ and $Z_2$ denote impedance components of the transmission line 2, and the transmission line 2 (which may be a microstrip line) is provided between the input terminal IN and the second switching portion 3. Further, a first control signal $CS_1$ is supplied to gate electrodes of the FETs $Q_1$ and $Q_2$, and a second control signal $CS_2$ is supplied to a gate electrode of the FET $Q_3$. Note, the first control signal $CS_1$ and the second control signal $CS_2$ are complementary signals, and thus the FETs $Q_1$,$Q_2$ of the first switching portion 1 and the FET $Q_3$ of the second switching portion 3 are complementarily switched.

In this switching circuit, in the case that the FETs $Q_1$, $Q_2$ and $Q_3$ are N-channel type transistors, and when the first control signal $CS_1$ is specified to a low level and the second control signal $CS_2$ is specified to a high level, the FETs $Q_1$ and $Q_2$ are switched OFF and the FET $Q_3$ is switched ON, so that the input terminal IN is connected to the output terminal OUT through the transmission line 2 and the ON state FET $Q_3$ (which is a switching ON state of the switching circuit). Note, in this switching ON state of the switching circuit, an impedance of the switching circuit is mainly determined by the impedance components $Z_1$ and $Z_2$, and thus a characteristic impedance of the switching circuit at the switching ON state can be defined by adjusting values of the impedance components $Z_1$ and $Z_2$.

Conversely, when the first control signal $CS_1$ is specified to a high level and the second control signal $CS_2$ is specified to a low level, the FETs $Q_1$ and $Q_2$ are switched ON and the FET $Q_3$ is switched OFF, so that the input terminal IN is connected to the output terminal OUT through the resistor R (which is a switching OFF state of the switching circuit). Note, in this switching OFF state of the switching circuit, an impedance of the switching circuit is mainly determined by the resistor R, and thus a characteristic impedance of the switching circuit at the switching OFF state can be defined by adjusting a resistance value of the resistor R.

As described above, in this switching circuit shown in FIG. 4, the characteristic impedance of the switching circuit can be defined to an optional value (for example, 50 Ω) by adjusting the values of the impedance components $Z_1$,$Z_2$ and the resistor R, regardless of the ON or OFF state of the switching circuit. Consequently, when connecting the switching circuit of the present embodiment to an objective circuit (for example, a measurement apparatus, a transceiver, a phased array system, and the like), an impedance matching between the switching circuit and the objective circuit can be realized by both switching ON and OFF states of the switching circuit, so that the signals input from the input terminal IN are not reflected thereby. Furthermore, according to the present embodiment, no FET of the first switching portion 1 is inserted and only one transistor (FET $Q_3$) of the second switching portion 3 is inserted in the transmission line 2 (or between the input terminal IN and the output terminal OUT), and thus insertion loss of the switching circuit can be small. Note, in the above embodiment, the number of the FETs of the first switching portion 1 is not limited to two, but it can be formed as a plural.

Figures 5A, 5B, 5C:
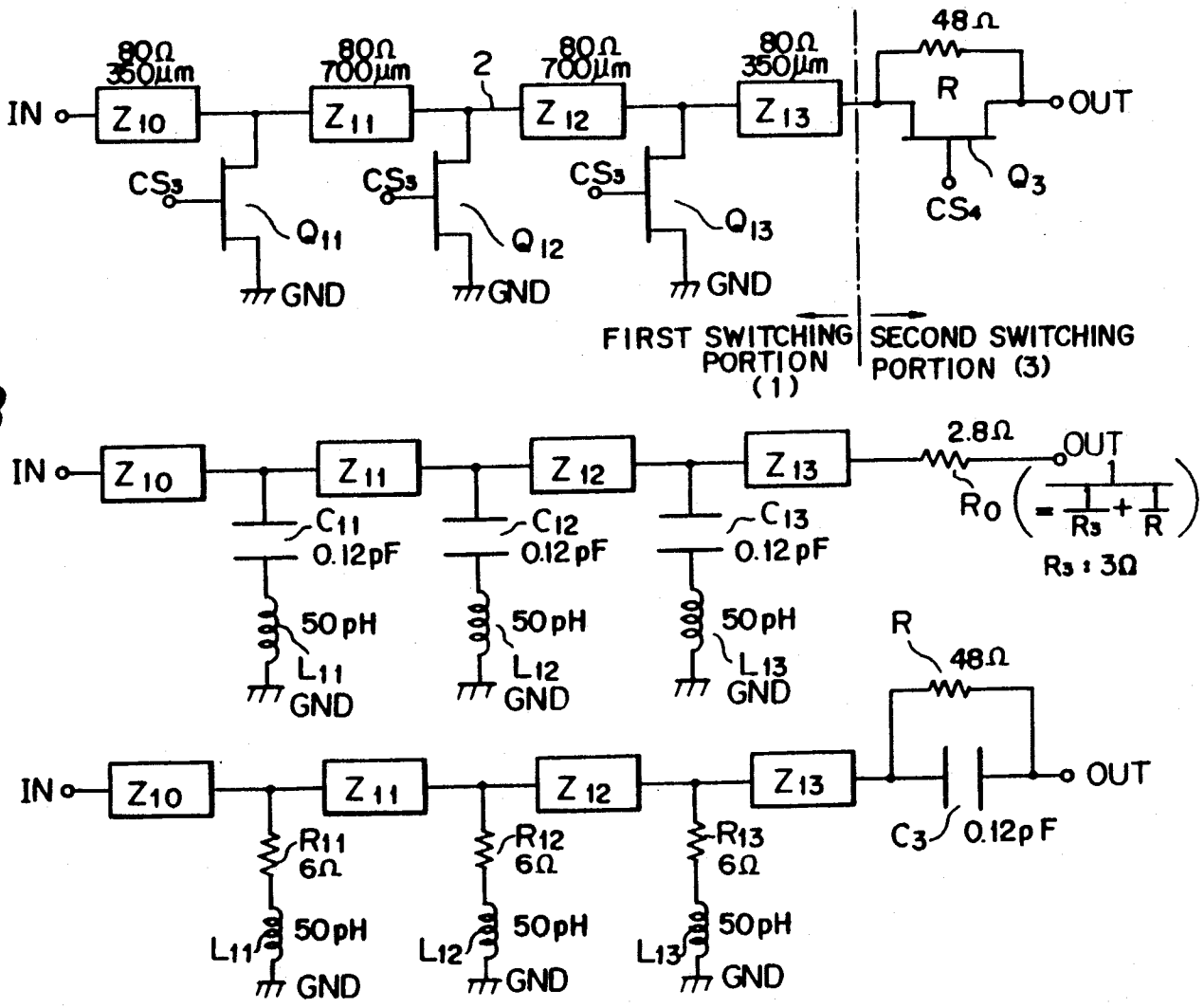
FIG. 5A is a circuit diagram indicating a modified embodiment of the switching circuit shown in FIG. 4.
FIGS. 5B and 5C are equivalent circuit diagrams indicating switching ON and OFF states of the switching circuit shown in FIG. 5A.

FIG. 5A is a circuit diagram indicating a modified embodiment of the switching circuit shown in FIG. 4, and FIGS. 5B and 5C are equivalent circuit diagrams indicating switching ON and OFF states of the switching circuit shown in FIG. 5A.

By comparing the switching circuit shown in FIG. 5A with that shown in FIG. 4, in the first switching portion 1 of the modified example shown in FIG. 5A, two impedance components (which are connected in series between the input terminal IN and the second switching portion 3) and one FET (which is connected between the transmission line 2 and the ground GND) are added to the configuration of the first switching portion shown in FIG. 4, and the second switching portion 2 has the same configuration as shown in FIG. 4.

As shown in FIG. 5A, the first switching portion 1 includes three FETs $Q_{11}$, $Q_{12}$, and $Q_{13}$ connected in parallel between the transmission line 2 and the ground GND, and the second switching portion 3 includes an FET $Q_3$ and a resistor R. Note, in the second switching portion 3, the FET $Q_3$ and the resistor R are connected in parallel between the first switching portion 1 and the output terminal OUT. Further, as shown in FIG. 5A, references $Z_{10}$, $Z_{11}$, $Z_{12}$, and $Z_{13}$ denote impedance components of the transmission line 2, and the transmission line 2 is provided between the input terminal IN and the second switching portion 3. Furthermore, the impedance components $Z_{10}$, $Z_{11}$, $Z_{12}$, and $Z_{13}$ correspond to transmission line 2, or divided transmission lines. In addition, a first control signal $CS_3$ is supplied to gate electrodes of the FETs $Q_{11}$, $Q_{12}$, and $Q_{13}$, second control signal $CS_4$ is supplied to a gate electrode of the FET $Q_3$ and the first control signal $CS_3$ and the second control signal $CS_4$ are complementary signals. Note, each of the FETs $Q_{11}$, $Q_{12}$, $Q_{13}$, and $Q_3$ are, for example, formed by a junction type FET, a MOS (Metal Oxide Silicon) type FET, and the like.

In this switching circuit, as shown in FIG. 5A, a resistance value of each of the impedance components $Z_{10}$, $Z_{11}$, $Z_{12}$, $Z_{13}$ is, for example, specified to 80 Ω, a length of each of the transmission lines corresponding to the impedance components $Z_{10}$ and $Z_{13}$ is, for example, specified to 350 μm, and a length of each of the transmission lines corresponding to the impedance components $Z_{11}$ and $Z_{12}$ is, for example, specified to 700 μm. Note, a resistance value of the resistor R is, for example, specified to 48 Ω. Further, each length of the transmission lines are determined above (350 μm or 700 μm), when the transmission lines (microstrip lines) are formed on a GaAs (Gallium Arsenic) substrate whose dielectric constant $\epsilon=13$.

As shown in FIG. 5B, in this switching circuit, when the switching circuit is at a switching ON state, the FETs $Q_{11}$, $Q_{12}$, and $Q_{13}$ are switched OFF, and the FET $Q_3$ is switched ON. Note, each of the OFF state FETs $Q_{11}$,$Q_{12}$,$Q_{13}$ is regarded as a capacitor ($C_{11}$,$C_{12}$,$C_{13}$), and the ON state FET $Q_3$ is regarded as a resistor ($R_0$). Note, a capacitance component $C_{11}$,$C_{12}$,$C_{13}$ of each of the OFF state FETs $Q_{11}$,$Q_{12}$,$Q_{13}$ is, for example, specified to 0.12 pF, and an inductive component $L_{11}$,$L_{12}$,$L_{13}$ between the transmission line 2 and the ground GND through each of the FETs $Q_{11}$,$Q_{12}$,$Q_{13}$ is, for example, specified to 50 pH. Further, a resistance component $R_3$ of the ON state FET $Q_3$ is, for example, specified to 3.0 Ω, and thus a resistance value $R_0$, which is combined by the resistor R (48 Ω) and the resistance component $R_3$ (3.0 Ω), is specified to 2.8 Ω. In the above description, the resistance component $R_3$ (which is a resistance value of the switched ON state FET $Q_3$) is smaller than that of each switched ON state FETs $Q_{11}$,$Q_{12}$,$Q_{13}$ in order to decrease an insertion loss of the switching circuit. Concretely, for example, a gate width of the FET $Q_3$ is formed longer than that of the FETs $Q_{11}$,$Q_{12}$,$Q_{13}$.

Note, the relationship between an insertion loss and a frequency in this switching circuit is indicated by a solid line $LL_{61}$ in FIG. 6.

In the switching ON state of the above switching circuit, an impedance of the switching circuit is determined by the impedance components $Z_{10}$, $Z_{11}$, $Z_{12}$, and $Z_{13}$. Concretely, the resistance value of each of the impedance components $Z_{10}$,$Z_{11}$,$Z_{12}$,$Z_{13}$ is specified to 80 Ω, and the impedance characteristics of the switching circuit at the switching ON state can be matched with internal impedances of objective circuits connected to an input terminal IN and an output terminal OUT of the switching circuit. Further, in order to decrease reflections, or decrease standing waves, a length of each of the transmission lines (350 μm) corresponding to the impedance components $Z_{10}$ and $Z_{13}$ is formed as a half length of that of the transmission lines (700 μm) corresponding to the impedance components $Z_{11}$ and $Z_{12}$.

As shown in FIG. 5C, in this switching circuit, when the switching circuit is at a switching OFF state, the FETs $Q_{11}$,$Q_{12}$, and $Q_{13}$ are switched ON, and the FET $Q_3$ is switched OFF. Note, each of the ON state FETs $Q_{11}$, $Q_{12}$,$Q_{13}$ is regarded as a resistor ($R_{11}$,$R_{12}$,$R_{13}$), and the OFF state FET $Q_3$ is regarded as a capacitor ($C_3$). Further, a resistance component $R_{11}$,$R_{12}$,$R_{13}$ of each of the ON state FETs $Q_{11}$,$Q_{12}$,$Q_{13}$ is, for example, specified to 6 Ω, and a capacitance component $C_3$ of the OFF state FET $Q_3$ is, for example, specified to 0.12 pF.

Note, the relationship between an isolation and a frequency in this switching circuit is indicated by a solid line $LL_{71}$ in FIG. 7, and the relationship between a return loss and a frequency in this switching circuit is indicated by a solid line $LL_{81}$ in FIG. 8.

In the switching OFF state of the above switching circuit, an impedance of the switching circuit is determined by the resistor R, the impedance components $Z_{10}$,$Z_{11}$,$Z_{12}$,$Z_{13}$, and the resistor values of the switching ON state FETs $Q_{11}$,$Q_{12}$,$Q_{13}$ especially determined by a resistor value of the resistor R. Concretely, the resistor value of the resistor R is specified to 48 Ω, each of the resistor values of the switching ON state FETs $Q_{11}$,$Q_{12}$,$Q_{13}$ is specified to 6 Ω. and the resistance value of each of the impedance components $Z_{10}$,$Z_{11}$,$Z_{12}$,$Z_{13}$ is specified to 80 Ω, and the impedance characteristics of the switching circuit at the switching OFF state can be matched with internal impedances of objective circuits connected to an input terminal IN and an output terminal OUT of the switching circuit. Note, a characteristic impedance of the switching circuit at the switching OFF state can be defined by adjusting a resistance value of the resistor R.

As described above, in this switching circuit shown in FIG. 5A, the characteristic impedance of the switching circuit can be defined to a optional value (for example, 50 Ω) by adjusting the impedance components $Z_{10}$,$Z_{11}$,$Z_{12}$,$Z_{13}$ and the resistor R, regardless of the ON or OFF state of the switching circuit.

FIG. 6 is a diagram indicating relationships between an insertion loss and a frequency in the switching circuits according to the related art and the present invention, FIG. 7 is a diagram indicating relationships between an isolation and a frequency in the switching circuits according to the related art and the present invention, and FIG. 8 is a diagram indicating relationships between a return loss and a frequency in the switching circuits according to the related art and the present invention. In FIGS. 6 to 8 each solid line $LL_{61}$,$LL_{71}$,$LL_{81}$ indicates characteristic of the switching circuit according to the present invention, or the switching circuit shown in FIGS. 5A to 5C, and each broken line $LL_{62}$,$LL_{72}$,$LL_{82}$ indicates characteristic of the switching circuit according to the related art, or the switching circuit shown in FIGS. 3A to 3C, in the frequency range from 1 GHz to 10 GHz.

First, as shown in FIG. 6, in switching ON state of the switching circuit, insertion loss characteristics of the present invention are smaller (by absolute value) than that of the related art, and thus according to the present invention (embodiment shown in FIG. 5A), signals (microwave signals from 1 GHz to 10 GHz) can be transferred by small degree of insertion loss. Namely, an insertion loss of the present invention (with reference to the solid line $LL_{61}$) is determined at about −1 dB during 1 GHz to 10 GHz, and an insertion loss of the related art (with reference to the broken line $LL_{62}$) is determined from about −1.3 dB to −2.5 dB during 1 GHz to 10 GHz, and thus the insertion loss of the present invention is smaller than that of the related art in all frequency band. For example, when the frequency (signals) is specified to 6 GHz, an insertion loss of the present invention is determined at −1.0 dB and an insertion loss of the related art is determined at −2.4 dB, so that the insertion loss of the present invention is smaller by −1.4 dB than that of the related art.

Further, as shown in FIG. 7, in switching OFF state of the switching circuit, both isolation characteristics of the present invention and the related art are preferable. An isolation of the present invention (with reference to the solid line $LL_{71}$) is determined from about −50 dB to −27 dB during 1 GHz to 10 GHz, and an isolation of the related art (with reference to the broken line $LL_{72}$) is determined from about −50 dB to −37 dB during 1 GHz to 10 GHz. Namely, the isolation of the present invention is smaller (by absolute value) than that of the related art, but the isolation of the present invention is lower than −25 dB at 10 GHz, and thus the isolation characteristics of the present invention are sufficiently small and have no problem in the present invention.

Next, as shown in FIG. 8, in switching OFF state of the switching circuit, return loss characteristics of the present invention is larger (by absolute value) than that of the related art, and thus according to the present invention, reflections of the signals input into the switching circuit can be determined to small. Namely, a return loss of the present invention (with reference to the solid line $LL_{81}$) is determined from about −22 dB to −25 dB during 1 GHz to 10 GHz, and a return loss of the related art (with reference to the broken line $LL_{82}$) is determined from about −9.0 dB to −20 dB during 1 GHz to 10 GHz, and thus the return loss of the present invention is larger (by absolute value) than that of the related art in all frequency band. For example, when the frequency is specified to 6 GHz, a return loss of the present invention is determined at −25 dB and a return loss of the related art is determined at −11 dB, so that the reflected signals from the switching circuit can be smaller by −14 dB than that of the related art. Consequently, according to the present invention, reflections of the signals can be decreased.

Figure 9:
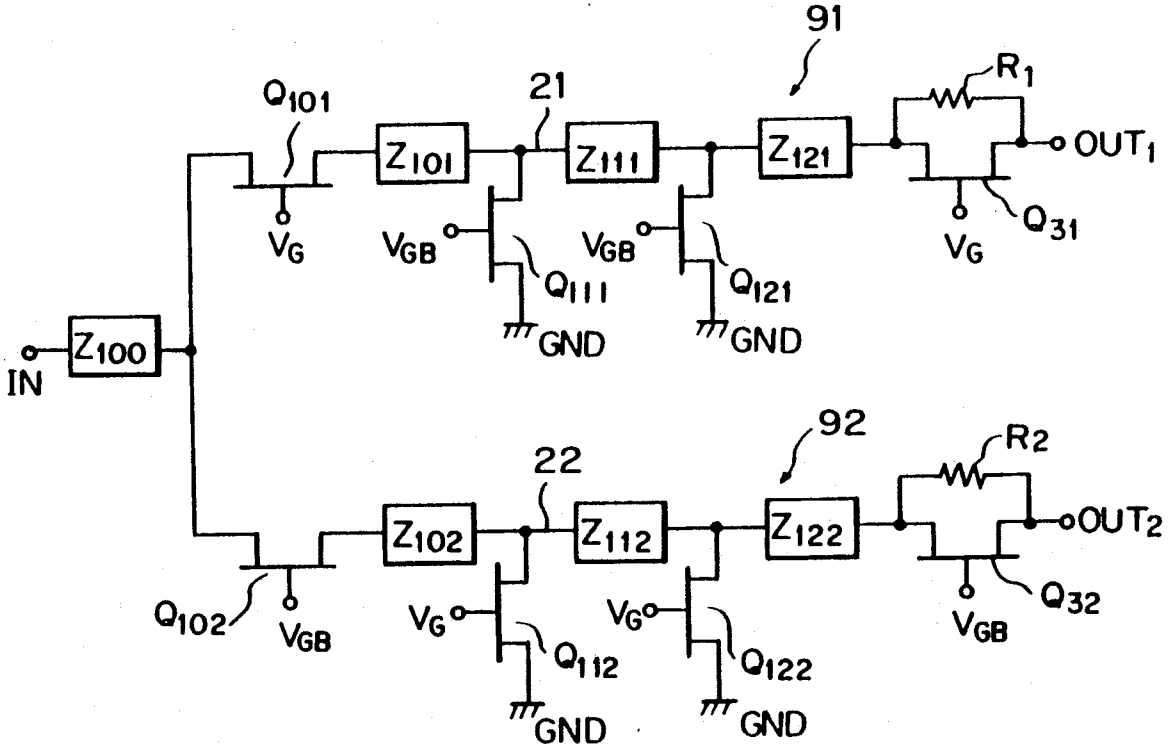
FIG. 9 is a circuit diagram indicating an embodiment of a single pole double throw switch according to the present invention.
Figure 10:
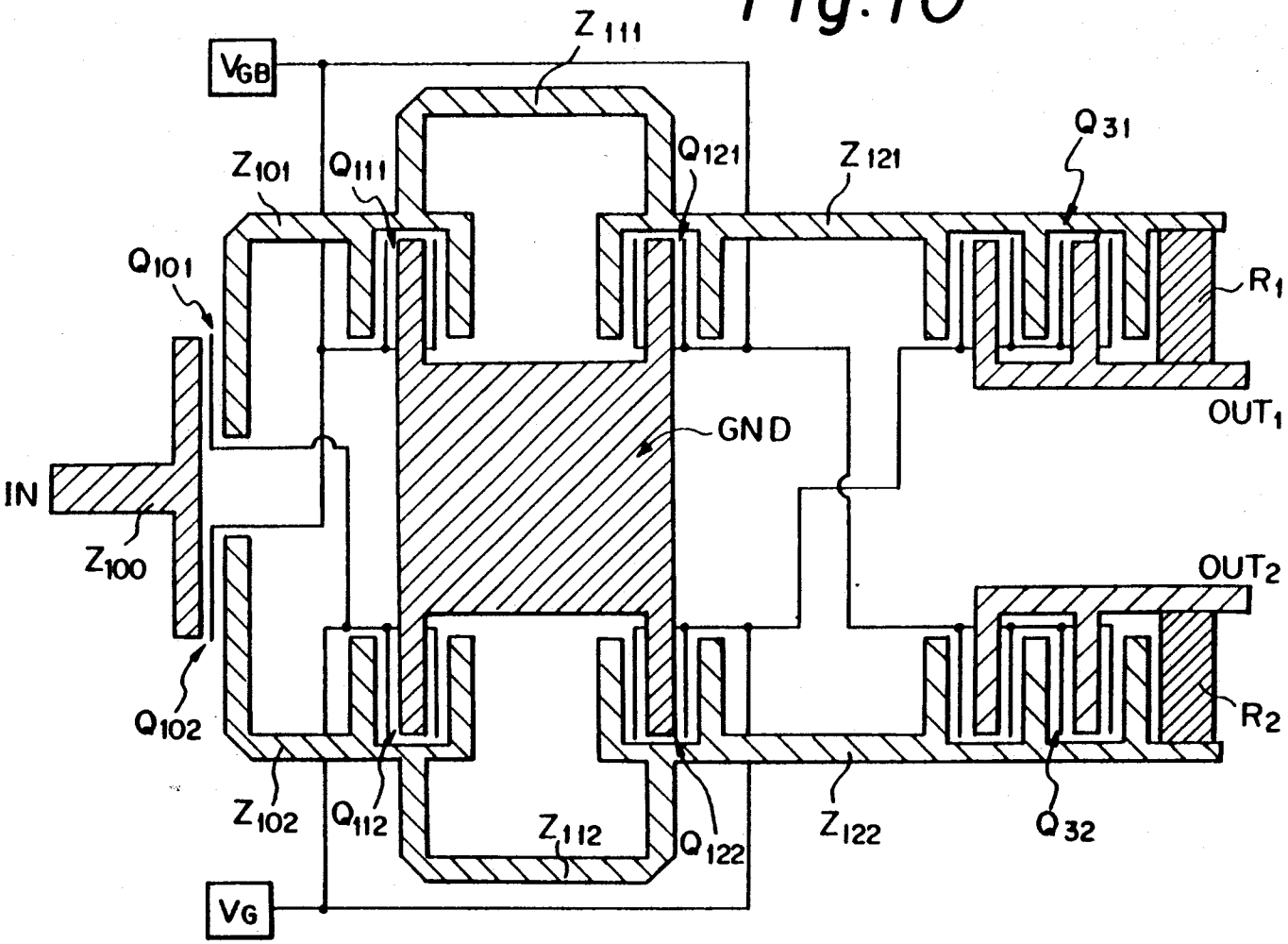
FIG. 10 is a diagram indicating a pattern of the single pole double throw switch shown in FIG. 9.

FIG. 9 is a circuit diagram indicating an embodiment of a single pole double throw switch according to the present invention, and FIG. 10 is a diagram indicating a pattern of the single pole double throw switch shown in FIG. 9.

As shown in FIGS. 9 and 10, the single pole double throw switch (SPDT) includes two switching circuits 91, 92, and one of the two switching circuits 91, 92 is switched ON and the other of the two switching circuits 91, 92 is switched OFF. One switching circuit 91 comprises four FETs $Q_{101}$, $Q_{111}$, $Q_{121}$, and $Q_{31}$, a transmission line 21 (impedance components $Z_{101}$, $Z_{111}$, and $Z_{121}$), a resistor $R_1$, and an output terminal $OUT_1$. Similarly, the other switching circuit 92 comprises four FETs $Q_{102}$, $Q_{112}$, $Q_{122}$, and $Q_{32}$, a transmission line 22 (impedance components $Z_{102}$, $Z_{112}$, and $Z_{122}$), a resistor $R_2$, and an output terminal $OUT_2$. Note, a first control signal $V_G$ is applied to gate electrodes of the FETs $Q_{101}$, $Q_{31}$, $Q_{112}$, and $Q_{122}$, and a second control signal $V_{GB}$ is applied to gate electrodes of the FETs $Q_{102}$, $Q_{32}$, $Q_{111}$, and $Q_{121}$. Further, the first control signal $V_G$ and the second control signal $V_{GB}$ are complementary signals. In addition, drain electrodes of the FETs $Q_{101}$ and $Q_{102}$ are connected to an input terminal IN through an impedance components $Z_{100}$ (transmission line, or a microstrip line).

By comparing the above SPDT with the switching circuit shown in FIG. 4, the FETs $Q_{111}$ and $Q_{112}$ correspond to the FET $Q_1$ of the first switching portion 1, the FETs $Q_{121}$ and $Q_{122}$ correspond to the FET $Q_2$ of the first switching portion 1 shown in FIG. 4, the FETs $Q_{31}$ and $Q_{32}$ correspond to the FET $Q_3$ of the second switching portion 3 shown in FIG. 4, and the resistor $R_1$ and $R_2$ correspond to the resistor R of the second switching portion 3 shown in FIG. 4, respectively. As shown in FIGS. 9 and 10, in the switching circuits 91 of the single pole double throw switch, a drain electrode of the FET $Q_{111}$ is connected to the input terminal IN through a transmission line corresponding to an impedance component $Z_{100}$, an FET $Q_{101}$, and a transmission line corresponding to an impedance component $Z_{101}$. Similarly, in the switching circuits 92 of the single pole double throw switch, a drain electrode of the FET $Q_{112}$ is connected to the input terminal IN through the transmission line corresponding to the impedance component $Z_{100}$, an FET $Q_{102}$, and a transmission line corresponding to an impedance component $Z_{102}$.

In the above described SPDT, all of the FETs $Q_{101}$, $Q_{111}$,$Q_{121}$,$Q_{31}$,$Q_{102}$,$Q_{112}$,$Q_{122}$,$Q_{32}$, are the same conduction type, and the first control signal $V_G$ and the second control signal $V_{GB}$ are complementary signals. Further, the single pole double throw switch shown in FIGS. 9 and 10 is used for switching microwave signals.

Note, a gate width of the FET $Q_{101}$ is formed as a half length of that of the FETs $Q_{111}$ and $Q_{121}$, and a gate width of the FET $Q_{102}$ is formed as a half length of that of the FETs $Q_{112}$ and $Q_{122}$. Further, a gate width of the FET $Q_{31}$ is formed as a double length of that of the FETs $Q_{111}$ and $Q_{121}$, and a gate width of the FET $Q_{32}$ is formed as a double length of that of the FETs $Q_{112}$ and $Q_{122}$, in order to decrease an insertion loss of the SPDT. In addition, the SPDT can be applied to a transceiver, a phased array system, and the like.

Many widely differing embodiments of the present invention may be constructed without departing from the spirit and scope of the present invention, and it should be understood that the present invention is not limited to the specific embodiments described in this specification, except as defined in the appended claims.

I claim:

1. A switching circuit, for controlling the transmission of signals by switching operation thereof, comprising:

an input terminal for receiving the signals;

an output terminal for outputting or not outputting the signals;

a transmission line having a specific impedance value, connected to said input terminal, for transferring the signals;

a first switching potion including a plurality of first transistors connected in parallel between said transmission line and ground, for controlling the impedance between said transmission line and ground in accordance with a first control signal supplied to a control electrode of each of said first transistors; and a second switching portion including a second transistor and resistor means connected in parallel with said second transistor and between said transmission line and said output terminal, for controlling the impedance between said transmission line and said output terminal in accordance with a second control signal supplied to a control electrode of said second transistor, wherein said first transistors and said second transistor are complementarily switched by said first and second control signals, an impedance value composed of said first and second switching portions being the same in both ON and OFF states of the switching circuit.

2. A switching circuit as claimed in claim 1, wherein said first transistors and said second transistor are the same conduction type field effect transistors, and said first and second control signals are complementary signals.

3. A switching circuit as claimed in claim 1, wherein said signals input to said switching circuit are microwave signals.

4. A switching circuit as claimed in claim 1, wherein said first switching portion includes a plurality of transistors and a plurality of impedance components on said transmission line, a length of said transmission line corresponding to a first impedance component connected to an input terminal being the same length as said transmission line corresponding to a last impedance component connected to said second switching portion, and lengths of said transmission line corresponding to intermediate impedance components placed between said first and last impedance components being the same.

5. A switching circuit as claimed in claim 4, wherein the length of said transmission line corresponding to each of said first and last impedance components is shorter than the length of said transmission line corresponding to each of the intermediate impedance components placed between said first and last impedance components.

6. A switching circuit as claimed in claim 5, wherein the length of said transmission line corresponding to each of said first and last impedance components is specified as a half length of said transmission line corresponding to each of said intermediate impedance components placed between said first and last impedance components.

7. A switching circuit as claimed in claim 1, wherein a gate width of each of said first transistors is shorter than a gate width of said second transistor.

8. A switching circuit as claimed in claim 7, wherein a gate width of each of said first transistors is specified as a half length of said second transistor.

9. A switching circuit as claimed in claim 1, wherein said transmission line is a microstrip line.

10. A single pole double throw switch, including two switching circuits, for selecting one of said two switching circuits for transferring signals through said selected one of said two switching circuits, each of said two switching circuits comprising:

an input terminal for receiving the signals;

an output terminal for outputting or not outputting the signals;

a transmission line having a specific impedance value, connected to said input terminal, for transferring the signals;

a first switching portion including a plurality of first transistors connected in parallel between said transmission line and ground, for controlling the impedance between said transmission line and ground in accordance with a first control signal supplied to a control electrode of each of said first transistors; and a second switching portion including a second transistor and resistor means connected in parallel with said second transistor and between said transmission line and said output terminal, for controlling the impedance between said transmission line and said output terminal in accordance with a second control signal supplied to a control electrode of said second transistor, said first transistors and said second transistor being complementarily switched by said first and second control signals, an impedance value composed of said first and second switching portions being the same in both ON and OFF states of each of said two switching circuit.

11. A single pole double throw switch as claimed in claim 10, wherein said input terminal of each of said two switching circuits is the same, and further comprising a third transistor connected in series between said input terminal and said transmission line in said each of said two switching circuits.

12. A single pole double throw switch as claimed in claim 11, wherein said first transistors, said second transistor, and said third transistor are the same conduction type field effect transistors, and said first and second control signals are complementary signals.

13. A single pole double throw switch as claimed in claim 10, wherein said signals input to said single pole double throw switch are microwave signals.

14. A single pole double throw switch as claimed in claim 10, wherein a gate width of each of said first transistors is shorter than a gate width of said second transistor.

15. A single pole double throw switch as claimed in claim 14, wherein the gate width of each of said first transistors is specified as a half length of said second transistor.

16. A single pole double throw switch as claimed in claim 10, wherein said transmission line is a microstrip line.

* * * * *

UNITED STATES PATENT AND TRADEMARK OFFICE

CERTIFICATE OF CORRECTION

PATENT NO. : 5,159,297

DATED : OCTOBER 27, 1992

INVENTOR(S) : YASUNORI TATENO

It is certified that error appears in the above-identified patent and that said Letters Patent is hereby corrected as shown below:

Col. 2, line 8, "Of" should be --of--.

Col. 5, line 37, "GMD. Mote," should be --GND. Note,--.

Col. 6, line 42, "101" should be -101'--.

Col. 7, line 17, "0.12 of," should be --0.12 pF,--;
line 18, "LO13" should be --$L_{013}$--;
line 20, "$_p$is," should be --is--;
line 41, "0.12 of." should be --0.12 pF.--.

Col. 13, line 10, "potion" should be --portion--.

Signed and Sealed this

Twelfth Day of October, 1993

*Attest:*

*Attesting Officer*

BRUCE LEHMAN

*Commissioner of Patents and Trademarks*